United States Patent [19]

Greenley

[11] 4,004,334

[45] Jan. 25, 1977

[54] METHOD OF MAKING A STRUCTURAL MEMBER

[76] Inventor: Henry R. Greenley, 1435 SE. 15th St., Apt. 104, Fort Lauderdale, Fla. 33316

[22] Filed: Mar. 10, 1976

[21] Appl. No.: 665,791

Related U.S. Application Data

[62] Division of Ser. No. 520,987, Nov. 5, 1974, abandoned.

[52] U.S. Cl. ..... 29/155 R; 29/6.1; 29/432; 113/1 M; 113/116 A; 113/116 HH

[51] Int. Cl.[2] ..... B23P 17/00

[58] Field of Search ..... 29/155 R, 6.1, 432; 113/1 M, 116 A, 116 F, 116 HH, 116 R; 72/324, 379; 52/434, 593, 595

[56] References Cited

UNITED STATES PATENTS

| | | | |
|---|---|---|---|
| 1,649,809 | 11/1927 | Campbell | 113/116 A |
| 1,675,825 | 7/1928 | Schlafly | 52/695 |
| 1,924,881 | 8/1933 | Ragsdale | 52/693 |
| 1,949,818 | 3/1934 | Tarbox | 52/695 |
| 2,026,972 | 1/1936 | Greene | 113/116 A |
| 2,191,788 | 2/1940 | Collins | 113/116 A |
| 3,111,204 | 11/1963 | Phare | 29/155 R X |
| 3,708,942 | 1/1973 | Leonard | 52/694 |

FOREIGN PATENTS OR APPLICATIONS

| | | | |
|---|---|---|---|
| 332,346 | 1/1921 | Germany | 52/693 |

*Primary Examiner*—Victor A. DiPalma
*Attorney, Agent, or Firm*—George A. Grove

[57] ABSTRACT

A method of making a chord and web structural member is disclosed wherein the web is formed from sheet material by suitable cutting, slotting, folding and expanding such that each strut of the web is either a U or Zee section member and the base surface of the strut is generally perpendicular to the longitudinal axis plane of the structural member. In a preferred embodiment the chords can be either timbers or metal and the web is formed of sheet steel.

3 Claims, 6 Drawing Figures

METHOD OF MAKING A STRUCTURAL MEMBER

This is a Division of my copending application Ser. No. 520,987, filed Nov. 5, 1974, now abandoned.

The subject invention relates to new structural members, particularly of the web and chord type, and to a method of forming and stretching the web portion thereof from sheet material, such as sheet metal, so that each load bearing leg of the web is either a U channel section or Zee section member.

It is an object of my invention to provide a new chord and web structural member which may be made efficiently and quickly from a number of different materials of construction as a particular application may require. A unique feature of my invention is that the web member is formed and stretched from sheet material, such as sheet steel. The sheet material is suitably cut, folded and expanded or stretched to form a web such that the load bearing leg members or struts of the web have either a channel section configuration or a Zee section configuration providing substantial strength and rigidity to the structural member. The chord members are attached to the web at the lateral edges thereof. The resulting structure, depending upon the selection of materials, has virtually any desired strength, rigidity and weight, but correspondingly of lighter weight than conventional types and may be employed in any of a large number of building applications.

It is another object of my invention to provide a method of forming a web and chord structural member, in which method the web can be formed from a single piece of sheet or strip material, such as sheet and/or strip steel. The sheet or strip of steel is slit transversely and progressively along its length. A given slit starts at one edge and extends partly across the sheet. Successive slits start at opposite sides of the sheet. The sheet is then twice folded between each slit as will be described in more detail below, and then expanded or stretched lengthwise as will be described to form the web structure. The resulting web structure is characterized by the fact that each of its load bearing legs has a base portion which will lie in a somewhat warped plane generally perpendicular to the longitudinal plane of the resulting structural member. Each such base surface has two adjacent stiffening surfaces produced by the folding operation. The result is that each load bearing leg or strut can be either a channel or Zee section shaped member having considerable strength and stiffness which is imparted to the resulting structural member. Assembly of the structural member is completed by attachment of chord members to the lateral edges of the web.

A more complete understanding of the objects and advantages of my invention will be obtained from a detailed description thereof, which follows. Reference will be had to the drawings, in which.

Figure 1:
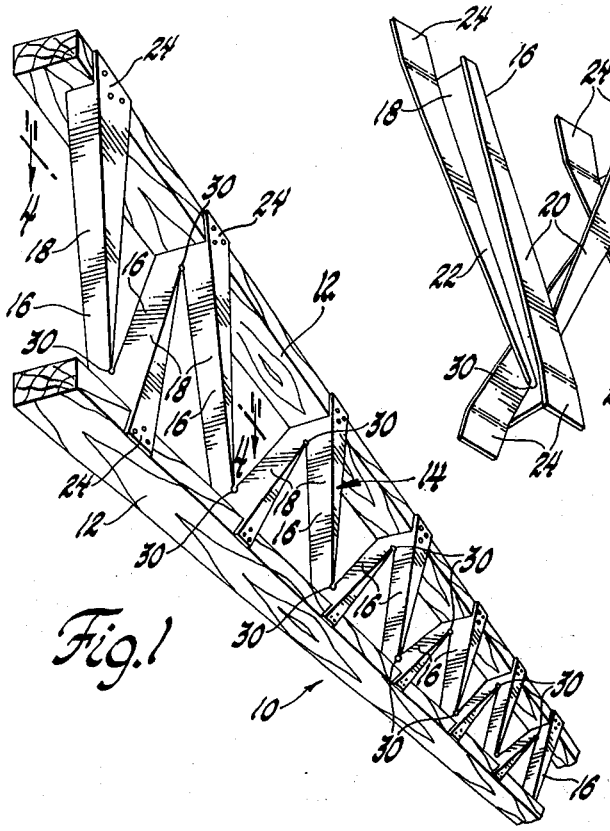
FIG. 1 is a perspective view of a structural member of the subject invention.
Figure 2:
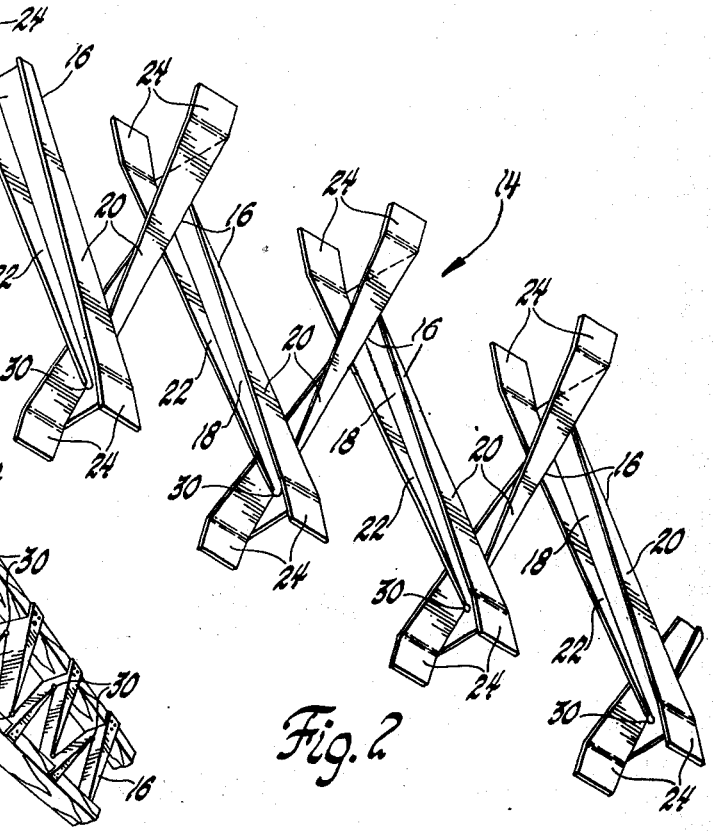
FIG. 2 is a self-standing web member like the web shown in FIG. 1 but showing another side thereof.

FIG. 1 shows a preferred embodiment of the structural member 10 of the subject invention. In this example the chord members 12 are formed of wood and the web is formed of steel. It is preferred that the web 14, as shown, be formed from a single piece of sheet or strip metal or other suitable material by slitting, slotting, folding and stretching or expanding the original sheet as will be described. The web 14 (see FIGS. 1 and 2) is made up of a plurality of interconnected load bearing legs or struts 16. Each strut 16 is produced by folding the previously slitted, flat sheet metal into the configuration of a U channel (FIG. 2) or Zee section (FIG. 5) member. Thus, each strut 16 is made up of a generally planar base section 18 which is stiffened and rigidified by generally planar side sections 20 and 22 which lie more or less perpendicular to the base section 18. In FIGS. 1 and 2, stiffening sections 20 and 22 are folded in the same direction and the struts 16 are U shaped channel members. In the embodiment shown, chord members 12 are affixed to the web 14 at the flanges 24, which are extensions of the stiffening side sections 20 and 22. The chord members can be affixed to the flanges 24 by staples, stitching, nails, bolts, screws, spot welding, riveting or any other suitable method of attachment.

Figure 4:
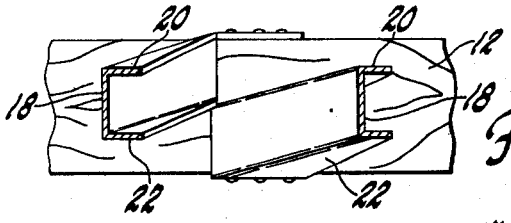
FIG. 4 is a section of the structural member of FIG. 1 taken along plane 4—4 thereof.
Figure 5:
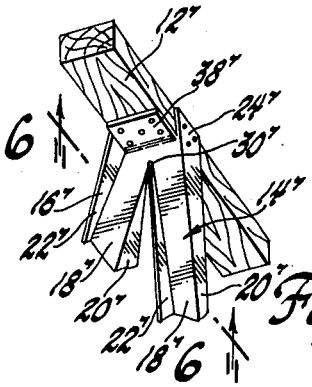
FIG. 5 is a perspective view of a broken out portion of another embodiment of the structural member of my invention.
Figure 6:
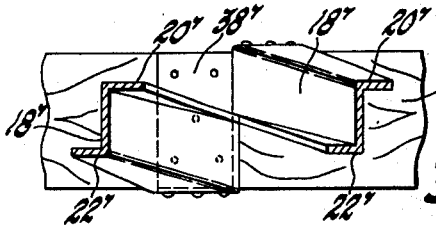
FIG. 6 is a section of the structural member shown in FIG. 5 taken along plane 6—6 thereof.

As can be seen, the base section 18 of each strut 16 is close to being planar in configuration although it is somewhat warped due to bending, which occurs during the expansion operation by which the web is formed. The base section 18 is generally perpendicular to the longitudinal plane of the structural member. Strengthening sections 20 and 22 are likewise generally planar though somewhat warped, and lie more or less parallel to the longitudinal plane of the structural member. Strengthening surfaces 20 and 22 may be folded in the same direction as shown in FIGS. 2 and 4 or in opposite directions as shown in FIGS. 5 and 6. The channel or Zee configuration of the struts provides substantial strength and rigidity to the overall structure member. Moreover, the web is readily formed or stretched from sheet or strip material by a simple cutting, folding and expanding operation and on a continuous basis.

Figure 3:
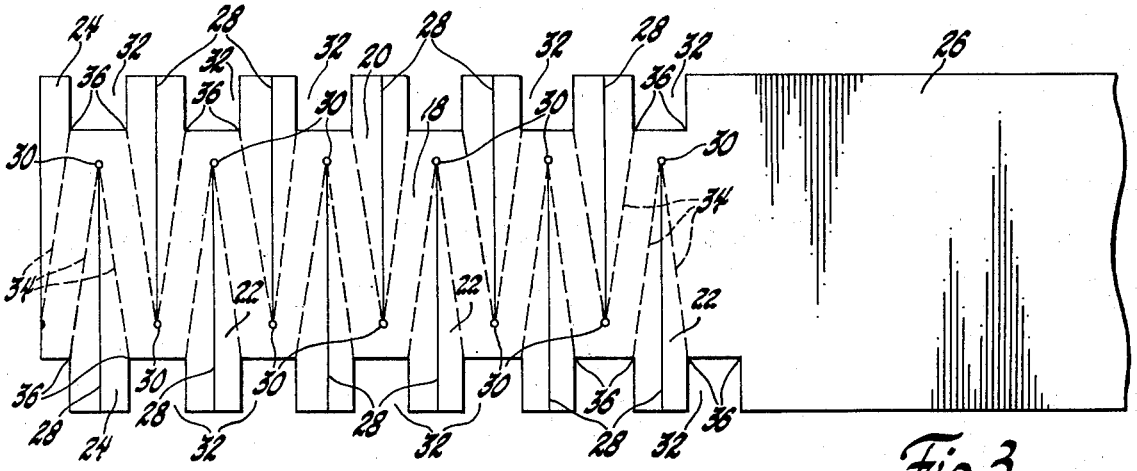
FIG. 3 is a layout of the sheet showing the slit lines and fold lines in preparation for the web manufacturing process.

In FIG. 3 is shown a flat sheet or strip 26 of material, typically metal, of indefinite length from which a web member 14 can be made. A portion of a strip 26 has been cut, slit and marked with fold lines in FIG. 3 to illustrate how the web structure of the subject invention is made. The sheet is progressively slit along its length. The slits indicated at 28 extend transversely from one edge of the sheet nearly across its width to a predetermined terminus 30 point near the opposite edge. Each terminus 30 may be a hole drilled in the sheet to also provide relief for stress areas. The slits 28 are parallel and alternate slits originate at opposite sides of the sheet. The material between a slit and the end of the sheet, or between adjacent slits, is the material which is used to form the channel or Zee shaped strut members of the web. As depicted in FIG. 3, small portions of the sheet are removed on each edge of the sheet to ultimately provide slots in which chord members 12 will be placed. The removed spaces or slot cross sections indicated at 32, must be of a size and configuration to accommodate at least part, if not the whole, cross-section of the chord members intended to be employed in connection with the web to be formed. It is seen that the slot sections 32 are in an alternating pattern along both edges of the strip. Each slot section 32 is located adjacent the terminus 30 of a slit 28.

The fold lines for generating the struts are indicated as dash lines at 34. It is seen that each fold line 34 (except for those at the end of a strip) runs from the terminus 30 of a slit toward the far edge of the sheet to a near corner 36 of a slot section 32. The two fold lines 34 between adjacent slits 28 are parallel. Each begins at the terminus 30 of an adjacent slit 28 and runs toward the opposite edge of the sheet.

Thus in the manufacture of a web 14 a sheet 26 is slit as described above and suitable slot sections 32 removed from the edges thereof, progressively along such edges to accommodate the chord members. Two folds are made between each pair of adjacent slits. To make the U channel struts 16 of the web of FIGS. 1 and 2 both folds are in the same direction. They would be in a direction either perpendicular above or perpendicular below the plane of FIG. 3. When the folds have been made it is seen that U channel-shaped strut members are produced, the folded sections 20 and 24 providing rigidity and strength to the struts 16 of the web 14. The structure is then expanded by pulling apart metal adjacent each slit in a manner such that the slot sections 32 on the same side of the web line up to accommodate a chord member. Such expansion will result in some bending of metal between the terminus 30 of each slit and the adjacent edge of the sheet, and some warpage of base sections 18 and stiffening sections 20 and 22. When the bending and expansion has been accomplished, the web member, indicated generally at 14, in FIGS. 1 and 2, is produced. The ears or flanges 24 at the ends of stiffening sections 20 and 22 are employed in attaching chord members 12 to the lateral edges of the web. Such attachment may be accomplished by any suitable means, including those specified above.

FIG. 5 illustrates another embodiment of the invention. The struts 16' of the web member are formed by bending the stiffening members 20' and 22' in opposite directions, both perpendicular to the base section 18', so as to form a Zee section. The slot sections (32 in FIG. 3) are formed by cutting the sheet at the sides of the slot and folding the metal, or other material, to form a flat 38' which is also employed to support and attach chord 12' to web 14'.

In general, in the practice of this invention it is preferred to use continuous strip steel to make the web member so that a unitary web comprising a large number of the V sections can be formed. Of course, it will be obvious to one skilled in the art that a large number of individual V sections could be formed and employed as desired.

The web member of the subject structural member can be of any suitable material, such as sheet or strip steel or sheet or strip aluminum. The web also can be made of plastic, paper, cardboard or other suitable material, depending upon the requirement for a particular application. Likewise, the chord can be made of wood, as shown. It can also be made of metal, plastic, flakewood or the like. An advantage of my invention is that the materials of construction of the various members can vary and provide a resultant structure of virtually any desired weight or strength.

The resultant structural members may be employed in any of a very large variety of construction applications. They can be employed as floor or ceiling joists, thus being substituted for the very expensive 2 × 8 inch (nominal) or 2 × 10 inch timbers now employed as joists. The subject structural members can also be used as rafter members or wall partition studs. They can be manufactured to any size, width and length as required by building code, architect specifications and the like.

While my invention has been described in terms of a specific embodiment thereof, it will be appreciated that other forms within the scope of the invention could readily be adapted by one skilled in the art. Accordingly, the scope of my invention is to be considered limited only by the following claims.

What is claimed is:

1. A method of making a web and chord structural member comprising:

slitting a strip of sheet material progressively along its length, each slit extending transversely from one edge of the strip across its width to a predetermined terminus point near the opposite edge, the slits being parallel and alternate slits originating at opposite sides of the strip, forming slot sections in the strip in a pattern alternating from side to side along the edges of the strip adjacent said terminus points, twice folding the portion of the strip between each pair of said slits to form strut members, stretching the slitted strip to form a web of struts interconnected in head-to-tail zig-zag arrangement with the slot sections at the edges of the web aligned to accommodate a chord member, and placing a chord member in said slot sections at each edge of the web and attaching the chord members to the web.

2. A method of making a web and chord structural member comprising:

slitting a strip of sheet material progressively along its length, each slit extending transversely from one edge of the strip partly across its width to a predetermined terminus point near the opposite edge, the slits being parallel and alternating slits originating at opposite sides of the strip, folding the strip twice between each pair of said slits along two generally parallel fold lines that each intersect a slit but are not parallel to it to form strut members, stretching the slitted strip to form a web of struts interconnected in head-to-tail zig-zag arrangement at the unsevered portions of the sheet adjacent the terminus of each slit, each strut having a planar section generally perpendicular to the longitudinal axis of the web, which section is stiffened by two side sections formed by said folding to be generally parallel to the axis of the web, and attaching a chord member to each of the two edges of the web.

3. A method of making the web portion of a web and chord structural member comprising:

slitting a strip of sheet material progressively along its length, each slit extending transversely from one edge of the strip partly across its width to a predetermined terminus point near the opposite edge, the slits being parallel and alternate slits originating at opposite sides of the strip, folding the strip twice between each pair of said slits along two generally parallel fold lines that are not parallel to the slits to form strut members, and stretching the slitted strip to form a web of struts interconnected in head-to-tail zig-zag arrangement at the unsevered portions of the sheet adjacent the terminus of each slit, each strut having a planar section generally perpendicular to the longitudinal axis of the web, which section is stiffened by two side sections formed by said folding to be generally parallel to the axis of the web.

* * * * *